US006959452B2

(12) United States Patent
Bradbury

(10) Patent No.: US 6,959,452 B2
(45) Date of Patent: Nov. 1, 2005

(54) BREATHABLE LIQUIDPROOF PROTECTIVE GLOVES AND COOLING LIQUIDPROOF PROTECTIVE GLOVES

(75) Inventor: Michael S. Bradbury, P.O. Box 2879, Edwards, CO (US) 81632

(73) Assignee: Michael S. Bradbury, Eagle, CO (US)

( * ) Notice: Subject to any disclaimer, the term of this patent is extended or adjusted under 35 U.S.C. 154(b) by 194 days.

(21) Appl. No.: 10/314,792

(22) Filed: Dec. 9, 2002

(65) Prior Publication Data

US 2004/0060095 A1 Apr. 1, 2004

Related U.S. Application Data

(60) Provisional application No. 60/413,289, filed on Sep. 26, 2002.

(51) Int. Cl.[7] ..... A41D 19/00
(52) U.S. Cl. ..... 2/159
(58) Field of Search ..... 2/16, 20, 158, 2/159, 160, 161.1, 161.6, 163

(56) References Cited

U.S. PATENT DOCUMENTS 1,206,102 A * 11/1916 Gibson ..... 2/159
2,451,758 A * 10/1948 Malm ..... 2/168
3,121,877 A * 2/1964 Ginter ..... 2/159
3,600,716 A * 8/1971 Berry ..... 2/167
3,992,723 A * 11/1976 Lazanas ..... 2/161.7
5,438,707 A 8/1995 Horn
5,740,551 A 4/1998 Walker
6,009,713 A 1/2000 Horn

* cited by examiner

*Primary Examiner*—Gary L. Welch

(57) ABSTRACT

The present invention provides a cooling protective glove to easily and effectively cool the human hand. By natural air and water vapor convection and associated conduction of heat, or the forced flow of other safe gases at an appropriate velocity and pressure, as required, and channeling it by means of an internally molded intrinsic distribution network that is incorporated into the glove. The natural cooling results from providing flow passages for air and water vapor pressure differentials between the parts of the hand, inside the protective glove and the cooler outside ambient conditions. Supplemental cooling may be achieved from a source of a cooling medium.

4 Claims, 14 Drawing Sheets

BREATHABLE LIQUIDPROOF PROTECTIVE GLOVES AND COOLING LIQUIDPROOF PROTECTIVE GLOVES

CROSS-REFERENCE TO RELATED APPLICATION

This application claims the benefit of Provisional Patent Application Ser. No. 60/413,289 filed Sep. 26, 2002.

FIELD OF INVENTION

The present invention relates to a protective glove allowing for high tactile sensitivity, dexterity, and breathability or cooling while protecting the wearer's hands from liquids and solids originating from outside sources.

DESCRIPTION OF PRIOR ART

Current basic liquid and solid impermeable protective gloves are constructed entirely from durable and elastic materials such as butyl rubber, nomex, neoprene/latex, or polyvinyl chloride. These gloves protect the wearer's hands from liquids and solids from outside sources while not greatly impeding hand dexterity and tactile sensitivity. An example of this type of protective glove would be the gauntlet style black or yellow butyl rubber glove which has not changed much over the last half century. Unfortunately these gloves are not able to expel either water vapor due to perspiration or heat produced from the wearer's hand and can cause significant discomfort to the wearer's hands when worn for even short periods of time. In some extreme cases of extended glove use a form of dermatitis may result in spite of preventive ointments and powders applied to the wearer's hands prior to insertion into the glove.

There have been various attempts in the past to address this inherent discomfort problem associated with solid and liquid impermeable protective gloves and there are several patents that reflect these efforts. Some of these patents involve the use of multiple layers of materials including laminated fabrics resulting in a bulky and uncomfortable hand garment. Other attempts involve the circulation of a cooling medium through a network of tubing incoperated into the design of the glove and a external coolant supply device connected to the glove. The results of these efforts are not acceptable for use in many delicate and precise applications due to the lack off hand and finger dexterity and sensitivity as well as being costly and difficult to manufacture. The limitations and inadequacies of these gloves is discussed in detail below.

The most common method of achieving glove breathability is to use laminated fabrics which allow gases to permeate through it but not allow solids or liquids to do the same. The laminated fabrics which will accomplish this function have existed for some time. Currently, the most commonly used waterproof, but breathable, laminated fabric is Gore-tex II.RTM. produced by W. L. Gore Associates Inc. A micro porous poly-tetrafluoroethylene (PTFE) laminate material is riddled with billions of tiny pores too small for water droplets to penetrate, but large enough for water vapor to escape. This micro porous PTFE is laminated to the inside of a wide variety of fabrics. The use of this fabric for glove construction has several drawbacks, including its cost. The PTFE membrane has no elastic recovery. In addition, the PTFE membrane is sensitive to scratching (hence its use as a "sandwich" laminate or as an insert in high performance garments). Glove construction from PTFE would also require the need for sewn seems and tapes to maintain its waterproof qualities which would make the glove bulky, uncomfortable and unsuitable for applications requiring high wearer tactile sensitivity.

U.S. Pat. No. 5,740,551 issued to Philip E. Walker discloses the utilization of multiple layers of fabric and a microporous laminate to achieve breathability. The glove described here includes an outer shell fabricated from a relatively flexible and durable material and a barrier insert fabricated from porous poly-tetrafluoroethylene ("PTFE") that is shaped to fit the inside of the outer shell. The glove also utilizes a third insert or inner layer constructed from cotton or cotton-polyester blend. The function of the insert is described as to provide the user protection from fluids from contaminating the skin while maintaining breathability. The addition of these inserts to the glove shell decreases the wearer's sensitivity and hand dexterity while dramatically increasing the cost of the gloves.

Other attempts to address the discomfort of wearing liquid proof gloves for long periods of time utilize the circulation of a cooling medium through a network of tubing incoperated into the design of the glove.

U.S. Pat. No. 5,438,707 issued to Stephen T. Horn on Aug. 8, 1995 describes a cooling garment using the direct expansion of compressed air. There is no mention of cooling appendages at all.

U.S. Pat. No. 6,009,713 issued to Stephen T. Horn on Jan. 4, 2000 provides a body cooling garment utilizing compressed air at a minimum rating of 70 psi and channeling it by means of a tubing network that is incorporated into body garments such as gloves. The cooling effect here is achieved through the rapid depresurization of the supplied compressed gas resulting in a very cold gas in combination with the evaporative effect of the gas as it circulates inside the glove and exits through a hole. This glove is directed at the welding and foundry industries where hot parts are routinely handled. The glove here requires a connection via tube to the glove for the supply of the cooling medium which would limit the range of effective use of the glove to the length of the tube and vicinity of compressed air supply. The use of a tube connected to the glove would also limit the dexterity of the glove wearer due to the fact the wearer must operate within the confines of the tubes flexibility as well as having the gloves attached to an apparatus. The tube could also pose a safety hazard due to the fact the hose could snag upon equipment or other objects surrounding the wearer.

None of the above mentioned patents, taken either singly or in combination, is seen to describe the inventions claimed.

SUMMARY OF INVENTION

It is one object of the present invention to provide comfortable articles of apparel which will allow water vapor due to perspiration and heat to transpire to the outside of the article so that the natural evaporative cooling effect can be achieved but will prevent liquids and solids from external sources from reaching the interior of the article. A particular object of the invention is to provide a hand wear article of the aforementioned characters which is comfortable to wear fits well, is pliant and is durable in use. In accordance with the present invention a breathable liquid proof protective glove comprises of a glove shell fabricated from an elastic and durable liquid impermeable material. A breathable liquid proof glove may also utilize any of the following; ventilation veins and/or veinletts, vein openings, and ventilation patches.

It is another object of the present invention to provide comfortable articles of apparel which will prevent liquids and solids from external sources from reaching the interior of the article and cool the wearer's hand through the use of cooling mediums without the use of coolant medium supplies or devices that restrict the glove's effective area of use and the dexterity of the wearer. A particular object of the invention is to provide a hand wear article of the aforementioned characters which is comfortable to wear fits well, is pliant and is durable in use. In accordance with the present invention a cooling liquid proof protective glove comprises of a glove shell fabricated from an elastic and durable liquid impermeable material. A cooling liquid proof glove may also utilize vein tubes, veins and/or veinletts, a gas distribution manifold, and a self-contained coolant supply device.

OBJECTS AND ADVANTAGE

"Accordingly, several objects and advantages of my invention are . . . "

(a) to provide a liquid proof protective glove that can be worn for extended periods of time with less discomfort than current liquid proof protective gloves.

(b) to provide a breathable or cooling liquid proof protective glove that maintains the wearer's hand dexterity and sensitivity.

(c) to provide a breathable liquid proof protective glove that does not rely upon glove inserts or layers to achieve breathability.

(d) to provide a simple and cost effective alternative to current expensive multi-layered breathable liquidrproof protective gloves.

(e) to provide a cooling liquid proof glove that does not depend upon coolant medium supplies or devices that restrict the glove's effective area of use and the dexterity of the wearer.

(f) further objects and advantages of my invention will become apparent from a consideration of the drawings and ensuing description.

DRAWING FIGURES

LIST OF REFERENCE NUMERALS

Figure 1:
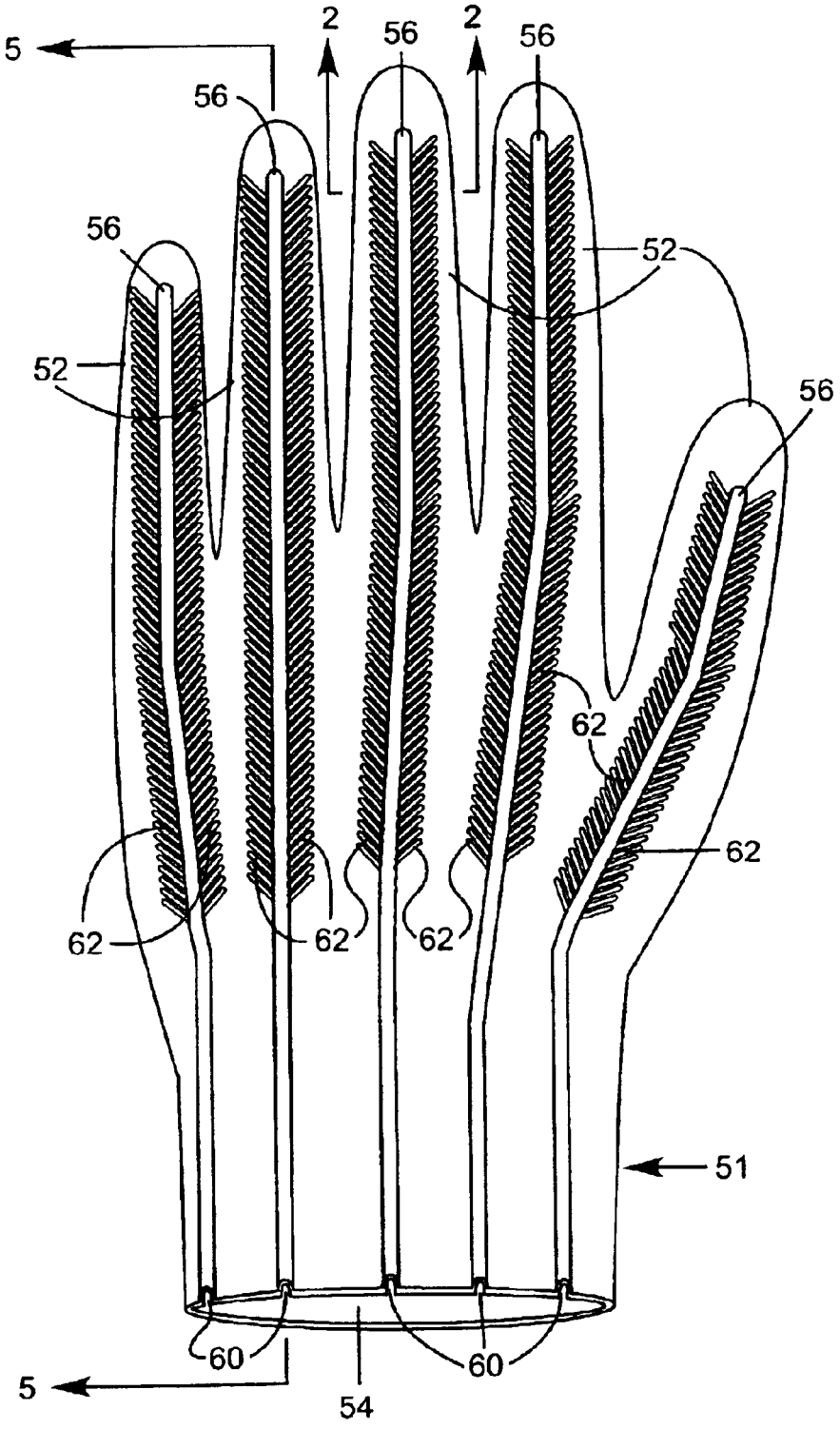
FIG. 1 shows a top view of the first embodiment of a breathable liquid proof glove with a ventilation vein system.

50. Glove material
51. Glove
52. Finger or thumb stall
54. Wrist opening
56. Ventilation vein
58. Ventilation vein end
60. Ventilation vein opening
62. Ventilation veinletts
64. Ventilation vein/veinlett connection
65. Vein gas volume
67. Veinlett gas volume
68. Vein tube volume
69. Breathable liquid proof material
71. Ventilation patch
72. Gas distribution manifold
74. Manifold inlet port
76. Manifold outlet port
78. Dry ice sublimation assembly
80. Ice compartment shell
82. Ice compartment door
84. Sublimation gas outlet
86. Exhaust vapor inlet
90. Ice vapor gas chamber
92. Dry ice compartment
94. Exhaust vapor chamber
96. Dry ice
102. Vein inlet port
104 Vein outlet port
106. Vein tube
108. Manifold inlet channel
110. Manifold outlet channel

DESCRIPTION OF INVENTION

Breathable liquid proof protective gloves with a ventilation vein system and wrist openings. FIGS. 1, 2, 3, 4, 5, 6.

In the description which follows:

The term "breathable" means the ability of an article to transport interior moisture vapor to the external environment. As used herein, the term "liquid proof" means the ability of an article to substantially prevent liquid from external sources from reaching the interior of the article. The term "glove material" means the material utilized for glove shell construction which has the characteristics of being elastic, durable and liquid proof. The gas occupying the volume contained between both veins (56) and the wearer's hand will be known heretofore as vein gas volume. The gas occupying the volume contained between both veinletts (62) and the wearer's hand will be known heretofore as veinlett gas volume. The above described effective combination of veins (56) and veinletts (62) will be known heretofore as a ventilation vein system.

FIG. 1 shows a top view of the wrist ending embodiment of the breathable liquid proof protective glove. The article here comprises a glove (51) constructed from a relatively elastic and durable liquid proof material. Ventilation veins (56) and ventilation veinletts (62) in this embodiment are elongated arch shaped hollow areas formed from glove material. Veins (56) and veinletts (62) are molded from the glove material during glove construction or molding process or are formed from the glove material after the glove molding process. Veins (56) and veinletts (62) also connect in a manner that will allow vein gas volume and veinlett gas volume to travel freely between veins (56) and veinletts (62).

Veins (56) extend from the ends of finger and thumb stalls (52) toward the wrist opening (54) of glove (51). Veins (56) terminate at ventilation vein openings (60) located at or near wrist opening (54) in a manner that will allow vein gas volume to freely exit the interior of glove (51). The palm or bottom side of the preferred embodiment may or may not be void of a ventilation vein system. A more detailed description of vein (56) and veinlett (62) construction and operation is described in FIGS. 3, 4 and 6.

Figure 2:
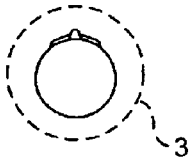
FIG. 2 shows a cut-a way view of a finger stall of the first embodiment of a breathable liquid proof protective glove.
Figure 3:
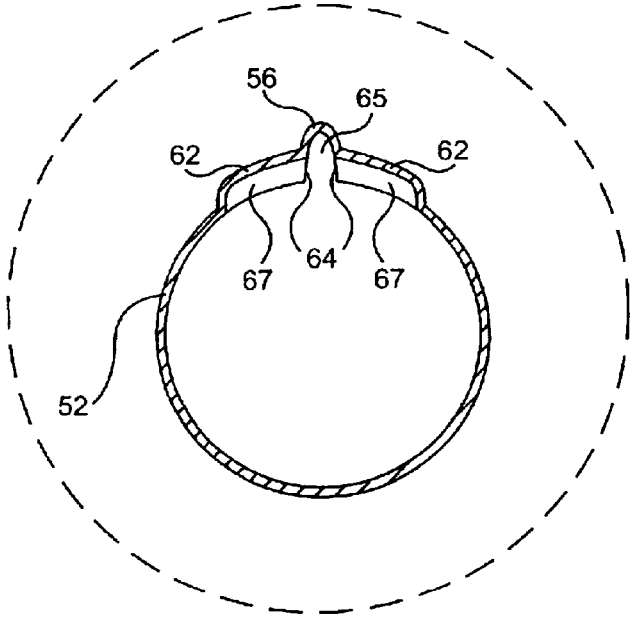
FIG. 3 shows an enlargement of FIG. 2.

FIG. 2 shows a cut-a-way view from FIG. 1 of a finger stall (52) with a vein (56) and veinletts (62). FIG. 3 shows an enlargement of the cut-a-way view from FIG. 2. Finger stall (52), ventilation veinletts (62), and a ventilation vein (56) are constructed from a relatively durable and elastic material. Finger stall (52), veinlett (62), and vein (56) all connect in a way which provides a liquid proof seal from external liquids between each item. Veins (56) and veinletts (62) connect at ventilation vein/veinlett connection (64) in a manner that will allow vein gas volume (65) and veinlett gas volume (67) to travel freely between veins (56) and veinletts (62).

Figure 4:
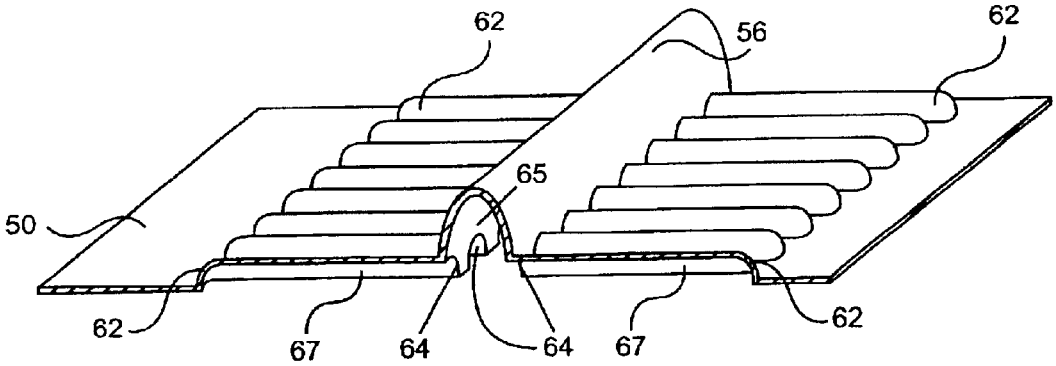
FIG. 4 shows a perspective cut-a-way view of a ventilation vein system of the first embodiment of the breathable liquid proof protective glove.

FIG. 4 shows an enlarged cut-a-way perspective view of a portion of a breathable liquid proof glove with a ventilation vein (56) and ventilation veinletts (62). This glove portion is constructed from a relatively durable and elastic liquid proof glove material (50). Ventilation veins (56) and ventilation veinletts (62) are elongated arch shaped hollow areas formed from glove material (50) or similar material. Veins (56) and veinletts (62) are molded from glove material (50) or similar material during glove construction or molding process or are formed after the glove molding process. Veins (56) and veinletts (62) connect at ventilation vein/veinlett connection (64) in a manner that will allow vein gas volume (65) and veinlett gas volume (67) to travel freely between veins (56) and veinletts (62).

Figure 5:
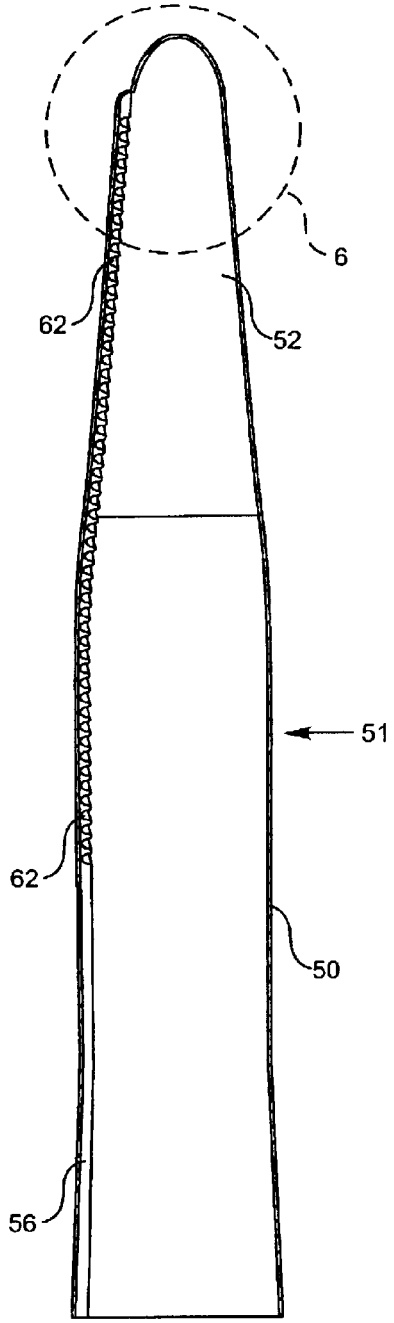
FIG. 5 shows a cut-a way view of the first embodiment of the breathable liquid proof glove with a ventilation vein system.

FIG. 5 shows a cut-a-way view from FIG. 1 of a glove (51). A Glove (51), and consequently finger stall (52), are constructed from a relatively elastic and durable liquid proof material. Ventilation veins (56) and ventilation veinletts (62) are elongated arch shaped hollow areas formed from glove material (50) or similar material. Veins (56) and veinletts (62) are molded from the glove material during glove construction or molding process or are formed from the glove material after the glove molding process. Veins (56) and veinletts (62) connect in a manner that will allow vein gas volume and veinlett gas volume to travel freely between veins (56) and veinletts (62).

Figure 6:
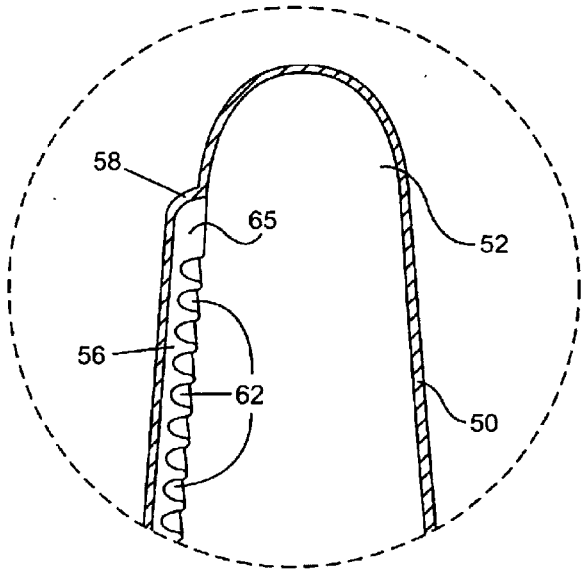
FIG. 6 shows and enlargement of a portion of FIG. 5.

FIG. 6 shows an enlargement from FIG. 5. Veins (56) and veinletts (62) are molded from the glove material (50) during glove construction or molding process or are formed from the glove material (50) after the glove molding process. Veins (56) and veinletts (62) connect in a manner that will allow vein gas volume and veinlett gas volume to travel freely between veins (56) and veinletts (62). The length of vein (56) ends on finger stall (52) at a ventilation vein end (58) which will terminate vein gas volume (65) and prevent vein gas volume (65) from exiting the interior of glove.

OPERATION OF INVENTION

Breathable liquid proof protective gloves with a ventilation vein system and wrist openings. FIGS. 1, 2, 3, 4, 5, 6.

Refer to FIGS. 1, 2, 3, 4, 5, and 6 for the following description of operation. The current embodiment of the breathable liquid proof protective gloves are worn in the same manner and purpose protective latex or butyl rubber gloves would be worn. A breathable liquid proof protective glove requires no specific operation in order to ventilate and protect the wearer's hand from external liquids and solids. As the hand temperature of the glove wearer rises and water vapor due to perspiration is produced inside of glove (51), the water vapor collects in and travels through ventilation veinletts (62) to ventilation veins (56). Water vapor then travels through veins (56) to ventilation vein openings (60) located at wrist opening (54) of glove (51) where it is allowed to exit to the outside environment of the glove. Conversely gases from the external environment of the glove are allowed to enter vein openings (60) to the interior of glove and be distributed throughout the ventilation vein system. This internal water vapor and external air exchange via glove's ventilation vein system thus achieves the natural evaporative cooling and drying effect to the wearer's hand. During this water vapor and air exchange process the liquid proof properties of the glove material will not allow external liquids or solids to enter the interior of the glove.

The current embodiment of the breathable liquid proof protective glove's ventilative properties can also be enhanced by the natural movements of the glove wearer's hand. The glove wearer's natural hand movement would stretch and relax the glove material. This action would flatten and raise the ventilation vein system which would in turn aid in expelling the warm internal water vapor and introduce circulating coo, air from the exterior environment of the glove. An example of this enhanced ventilative property of the current embodiment of the breathable liquid proof protective glove could simply be the action of the glove wearer to first make a fist and then second to relax the hand. This first action would stretch the glove material and thus flatten the ventilation vein system and push the warm internal water vapor through the ventilation vein system and finally through ventilation vein openings (60) to the exterior environment of the glove. The second action of relaxing the hand will allow the glove material to relax thus allowing the ventilation vein system to return to its original shape thus creating a partial vacuum inside the glove. This partial vacuum would pull cool external air through the vein openings (60) where it will be distributed throughout the ventilation vein system thus cooling and drying said glove wearer's hand.

Vein openings (60) in this embodiment are located near the wrist end of the glove (54) which decreases the possibility they will be submerged in liquids or solids and thus aiding the ventilation process while maintaining the liquid proof properties of said glove. There are numerous possibilities for the quantity, locations and shape of the ventilation veins and ventilation veinletts of the present embodiment of the invention. Each embodiment described hereafter will have significant differences from the preferred embodiment.

DESCRIPTION OF INVENTION

Breathable liquid proof protective glove utilizing breathable waterproof laminates. FIGS. 7, 8, 9, 10, 11.

As stated previously in FIG. 1 the gas occupying the volume contained between both veins (56) and the wearer's hand will be known as vein gas volume. Also as stated previously in FIG. 1 the gas occupying the volume contained between both veinletts (62) and the wearer's hand will be known as veinlett gas volume. As stated previously in FIG. 1 the above described effective combination of veins (56) and veinletts (62) will be known as a ventilation vein system.

Figure 7:
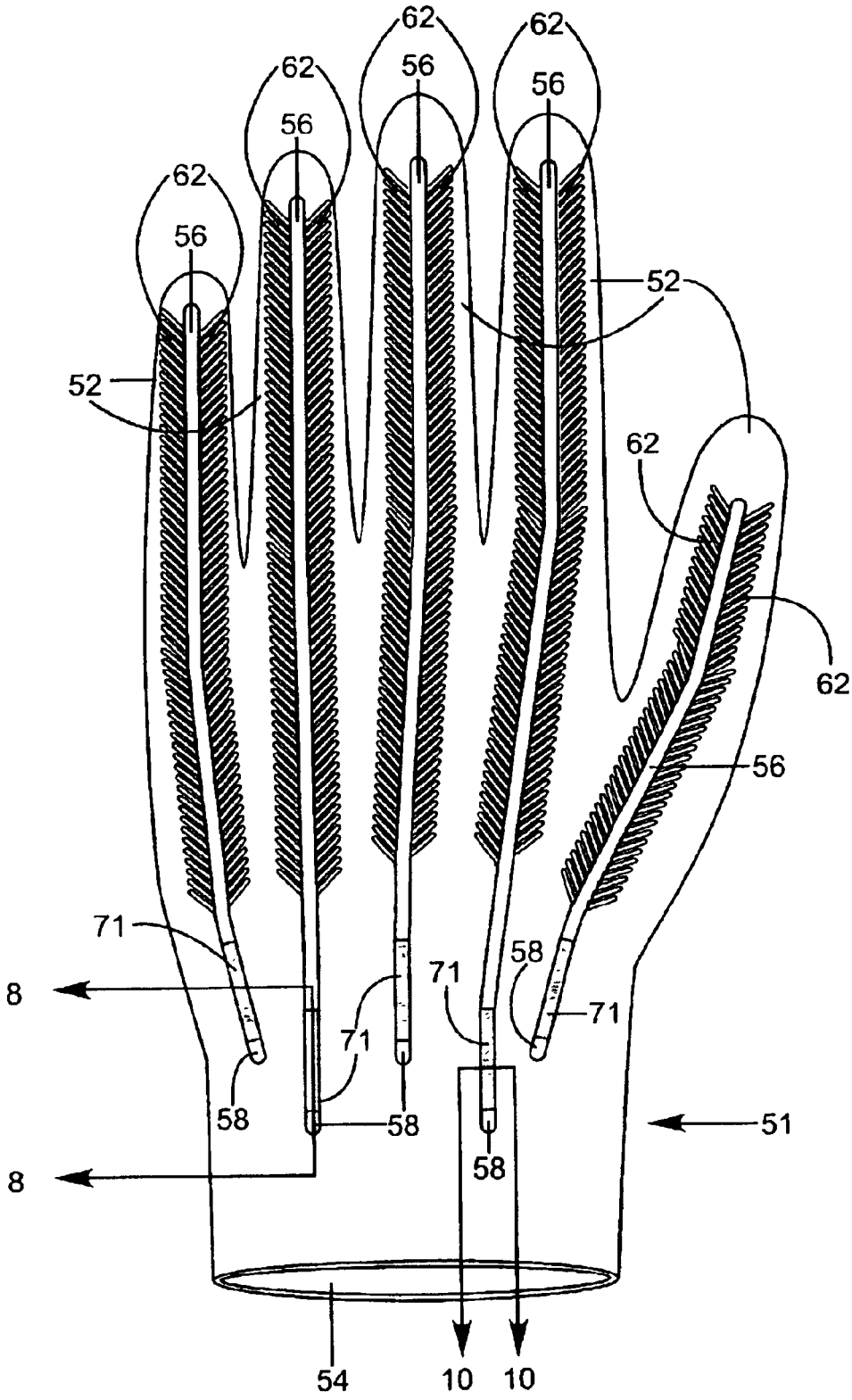
FIG. 7 shows a top view of a breathable liquid proof protective glove with a ventilation vein system and ventilation patches.

FIG. 7 shows a top view of the ventilation patch embodiment of the breathable liquid proof protective glove. The article here comprises a glove (51) constructed from a relatively elastic and durable liquid proof material. Ventilation veins (56) and ventilation veinletts (62) are elongated arch shaped hollow areas formed from glove material. Veins (56) and veinletts (62) are molded from the glove material during glove construction or molding process or are formed from the glove material after the glove molding process. Veins (56) and veinletts (62) connect in a manner that will allow glove's (51) vein gas volume and veinlett gas volume to travel freely between veins (56) and veinletts (62). A more detailed description of vein (56) and veinlett (62) construction and operation is described in FIGS. 3, 4 and 6.

Veins (56) extend from the ends of finger and thumb stalls (52) toward the wrist opening (54) where they connect to ventilation patches (71). Ventilation patches (71) also connect to ventilation vein ends (58) which will terminate veins' (56) vain gas volume near patches (71). The palm or bottom side of the preferred embodiment may or may not be void of a ventilation vein system and ventilation patches (71). A more detailed description of ventilation patch (71) construction can be viewed in FIG. 8, the cut-a-way view from FIG. 7.

Figure 8:
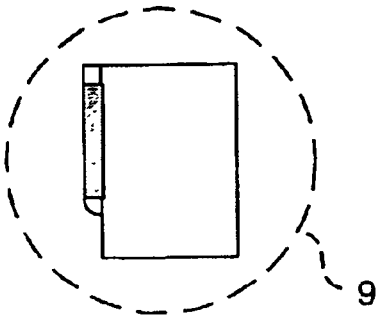
FIG. 8 shows a cut-a-way view of a ventilation patch construction from FIG. 7.
Figure 9:
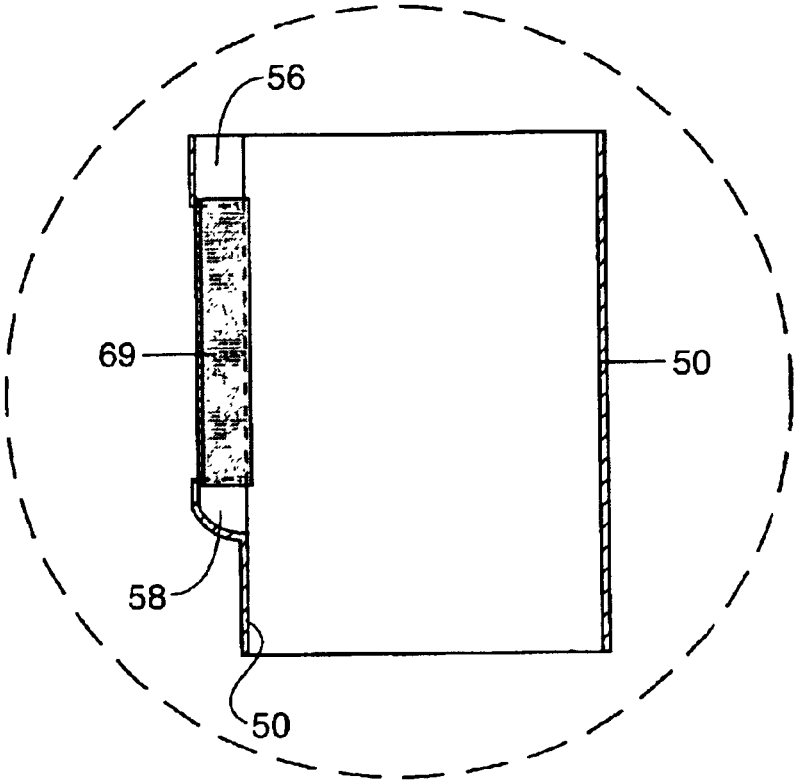
FIG. 9 shows an enlargement of FIG. 8
Figure 10:
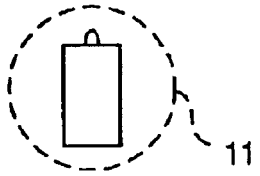
FIG. 10 shows a cut-a-way view of a ventilation patch construction from FIG. 8.
Figure 11:
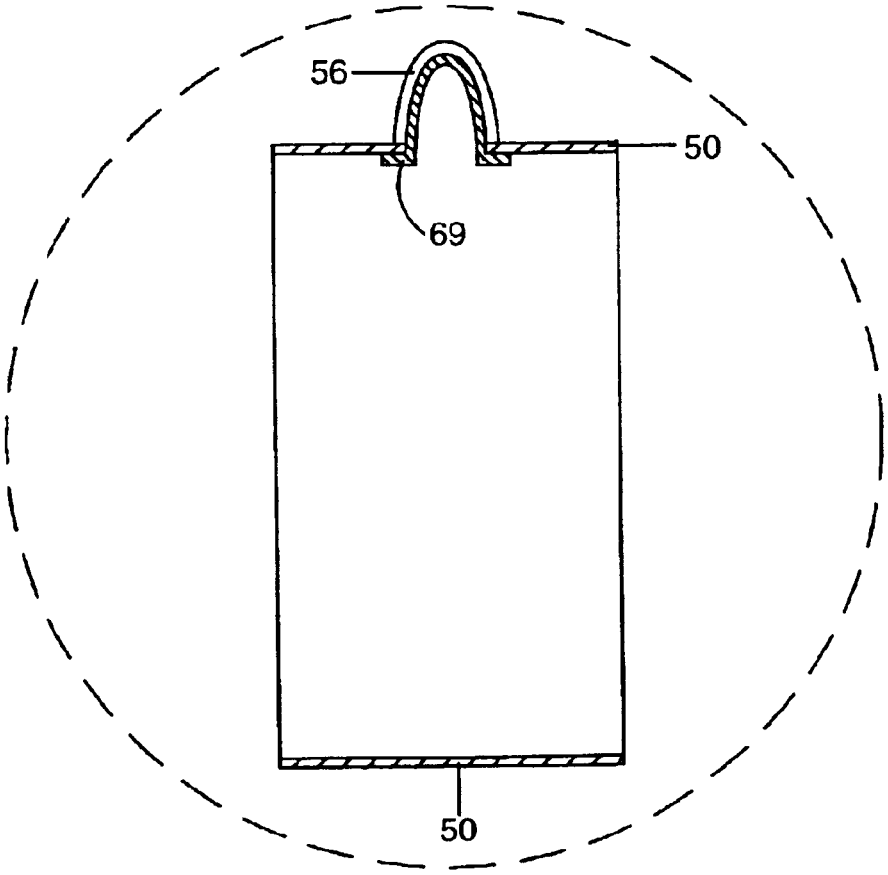
FIG. 11 shows an enlargement of FIG. 10

FIGS. 8 and 10 show cut-a-way views of a ventilation patch construction from FIG. 7. FIGS. 9 and 11 shows enlargements of FIGS. 8 and 10 respectively and are described as follows. A ventilation vein (56) is an elongated arch shaped hollow portion formed from glove material (50). Vein (56) is molded from glove material (50) during glove construction or molding process or is formed from the glove material after the glove molding process. A predetermined sized hole is cut into or molded from vein (56). A piece of breathable liquid proof material (69), such as poly-tetrafluoroethylene PTFE or similar material, is attached to glove material (50) surrounding the hole by a means which provides a durable liquid proof seal between breathable liquid proof material (69) and glove material (50). This means of attachment may utilize a liquid proof adhesive and/or the molding of the breathable liquid proof material directly into the glove material. This assembly of breathable liquid proof material (69) to glove material (50) by the means previously described will be collectively known as a ventilation patch.

OPERATION OF INVENTION

Breathable liquid proof protective glove utilizing breathable waterproof laminates. FIGS. 7, 8, 9, 10, 11.

Refer to FIGS. 7, 8, 9, 10, and 11 for the following description of operation. Breathable liquid proof protective gloves are worn in the same manner and purpose protective latex or butyl rubber gloves would be worn. A breathable liquid proof protective glove requires no specific operation in order to ventilate and protect the wearer's hand. As the hand temperature of the glove wearer rises and water vapor due to perspiration is produced inside of glove (51), the water vapor collects in and travels through ventilation veinletts (62) to ventilation veins (56). Water vapor then travels through veins (56) to ventilation patches (71) where it is allowed to transpire to the outside environment of glove (51). Conversely gases from the external environment of the glove are allowed to transpire through ventilation patches to the interior of glove (51) and be distributed throughout the ventilation vein system of glove (51). This internal water vapor and external air exchange via glove's (51) ventilation vein system thus achieves the natural evaporative cooling and drying effect to the wearer's hand. During this water vapor and air exchange process the liquid proof properties of glove (51) and ventilation patches will not allow external liquids or solids to enter the interior of the glove.

The current embodiment of the breathable liquid proof protective glove's ventilative properties can also be enhanced by the natural movements of the glove wearer's hand. Natural hand movement would stretch and relax the glove material which would in turn flatten and raise the ventilation vein system which would in turn aid in expelling the warm internal water vapor and circulating cool air from the exterior environment of the glove via ventilation patches. An example of this enhanced ventilative property of the current embodiment of the breathable liquid proof protective glove could simply be the action of the glove wearer to first make a fist and then second to relax the hand. This first action would stretch the glove material and thus flatten the ventilation vein system and push the warm internal water vapor through the ventilation vein system and finally through ventilation patches to the exterior environment of glove (51). The second action of relaxing the hand will allow the glove material to relax thus allowing the ventilation vein system to return to its original shape thus creating a partial vacuum inside the glove This vacuum would pull cool external air through the ventilation patches where it will be distributed throughout the ventilation vein system thus cooling and drying said glove wearer's hand.

Ventilation patches (71) in this embodiment, FIG. 7, are located near the wrist end (54) of glove (51) which decreases the possibility they will be submerged in liquids or solids and thus aiding the ventilation process while maintaining the liquid proof properties of glove (51). The raised vein shape of the patch will aid the shedding of liquid or solid material from the patch thus also aiding the ventilation process. There are numerous possibilities for ventilation patch, ventilation vein, and ventilation veinlett number, location, and shape, of the present invention. Each embodiment described hereafter will have significant differences from the preferred embodiment.

DESCRIPTION OF INVENTION

Cooling liquid proof protective glove with positive flow ventilation vein system and gas distribution manifold. FIGS. 12, 13, 14, 15, 16, 17, 18, 19, 20, 21.

Veins (56) in this embodiment are identical to previous embodiments except as described below. The term "positive flow ventilation vein system" here describes a ventilation vein system consisting of veins (56) or vein tubes (106) with no ventilation vein ends. Veins (56) or vein tubes (106) have no interruption of vein gas volume except at predetermined openings and by ventilation veinletts which not shown here. A more detailed description of vein tubes (106) can be found in FIGS. 15 and 16.

Figure 12:
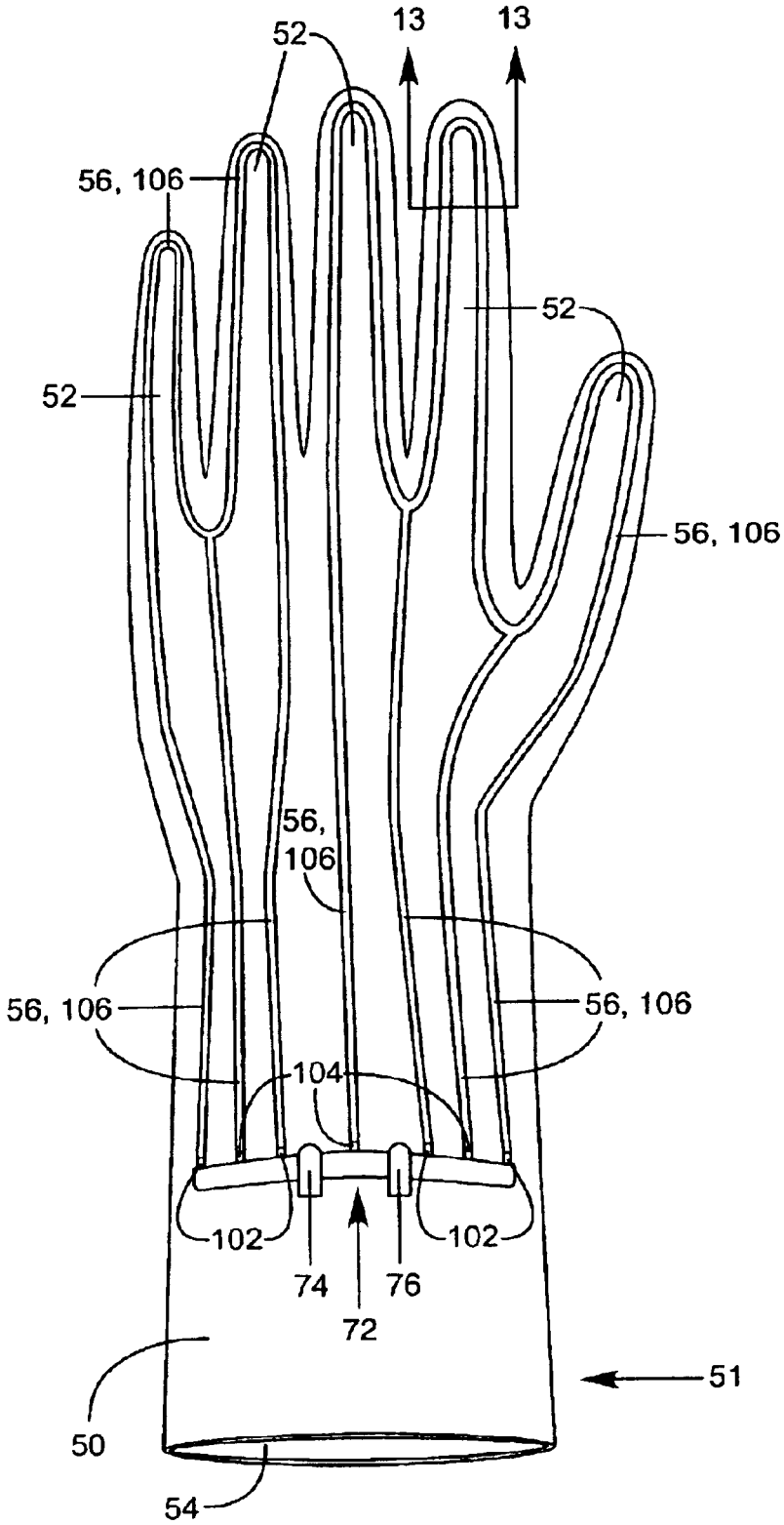
FIG. 12 shows a top view of a cooling liquid proof protective glove with a positive flow ventilation vein system and a gas distribution manifold.

FIG. 12 shows a top view of a cooling liquid proof protective glove (51) with a positive flow ventilation vein system and a gas distribution manifold (72). A gas distribution manifold (72) has vein inlet ports (102) and vein outlet ports (104) which are attached to veins (56) or vein tubes (106) in a manner that will allow gas to travel freely between the two and that will provide a liquid proof seal from the exterior environment of glove (51). A more detailed description of gas distribution manifold can be found in FIGS. 17, 18, 19, 20, and 21. This attachment of gas distribution manifold (72) to veins (56) or tubes (106) can be achieved utilizing adhesive or the direct molding of manifold (72) into glove material (50) during glove (51) molding process. Veins (56), as described in FIGS. 3, 4, and 6 or vein tubes (106) as described in FIGS. 15 and 16, begin at vein inlet ports (102) of manifold (72) and extend towards of finger and thumb stalls (52) of glove (51). Veins (56) return uninterrupted from stalls (52) to and terminate at vein outlet ports (104). The gas distribution manifold (72) for this embodiment is located near wrist opening (54) of glove (51).

Figure 13:
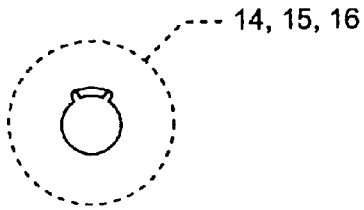
FIG. 13 shows a cut-a-way view of a finger stall from FIG. 12.

FIG. 13 shows a cut-a-way view of a finger stall from FIG. 12.

Figure 14:
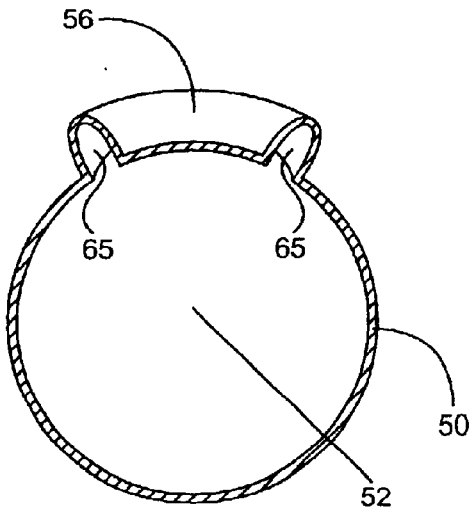
FIG. 14 shows an enlargement of FIG. 13 detailing the construction of a ventilation vein.

FIG. 14 shows an enlargement of FIG. 13. Finger stall (52) and a ventilation vein (56) are constructed from a relatively durable and elastic material. Finger stall (52) and vein (56) connect in a way which provides a liquid proof seal from external liquids between each item. Vein (56) contains vein gas volume (65).

Figure 15:
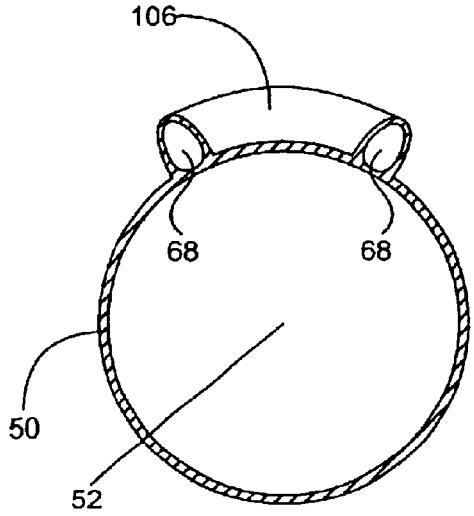
FIG. 15 shows an enlargement of FIG. 13 detailing the construction of a tube vein.

FIG. 15 shows a variation of an enlargement from FIG. 13 with vein tubes (106) instead of veins. A cooling liquid proof protective glove with a positive flow ventilation vein system may also utilize vein tubes (106) instead of veins. A vein tube (106) is an elongated circular shaped hollow area formed from glove material (50). Vein tube (106) is molded from the glove material (50) during glove construction or molding process or is formed from the glove material after the glove molding process.

Figure 16:
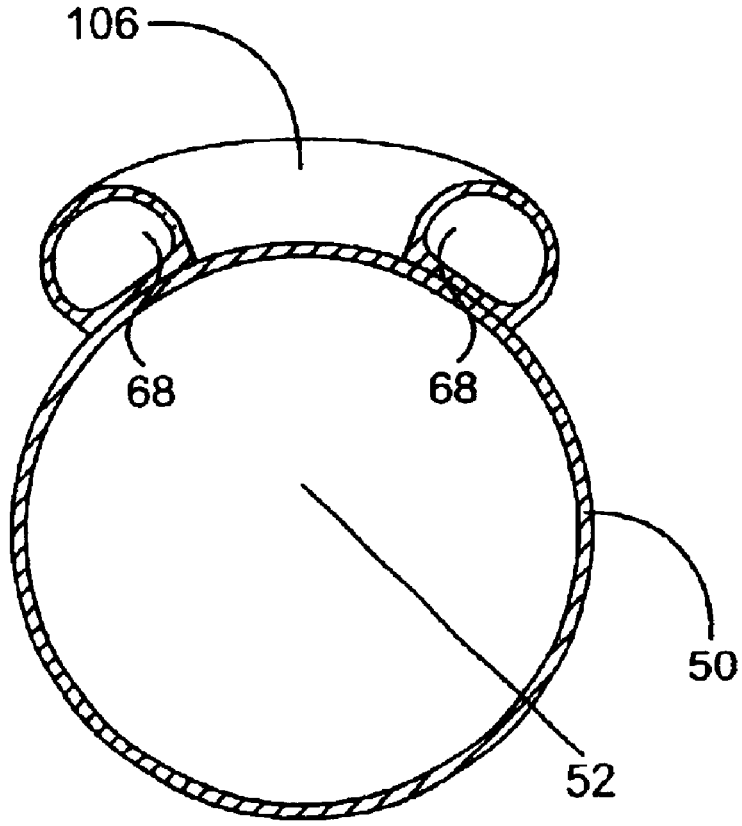
FIG. 16 shows an enlargement of FIG. 13 detailing the construction of a tube vein attached to glove material.

FIG. 16 shows another variation of an enlargement from FIG. 13 with vein tubes (106) instead of veins. A vein tube (106) here is formed as a piece separate from the glove shell. Vein tube (106) is an elongated circular shaped hollow area formed from a relatively elastic and durable liquid proof material. Tube (106) here is attached directly to the outside of a glove shell. Tube (106) may be molded directly into the outside of a glove shell during glove construction or is attached after glove construction via adhesive, heat or similar methods.

Figure 17:
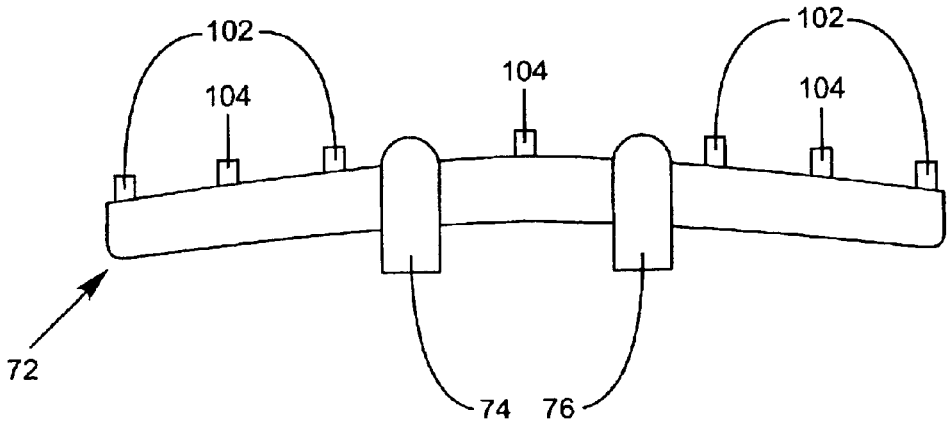
FIG. 17 shows a top view of a gas distribution manifold.
Figure 18:
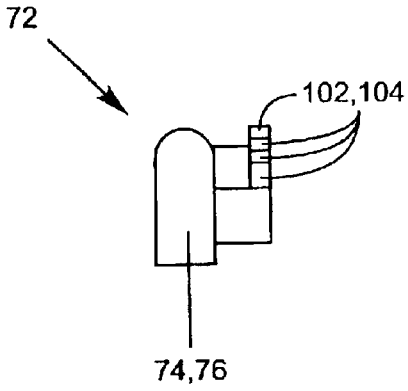
FIG. 18 shows a side view of a gas distribution manifold.

FIG. 17 shows a top view and FIG. 18 shows a side view of a gas distribution manifold (72). Manifold (72) is constructed from a rigid or semi-rigid waterproof material. Manifold inlet port (74), manifold outlet port (76), vein inlet ports (102) and vein outlet ports (104) can also be viewed. A more detailed description of manifold (72) construction can be viewed in FIGS. 19, 20, and 21.

Figure 19:
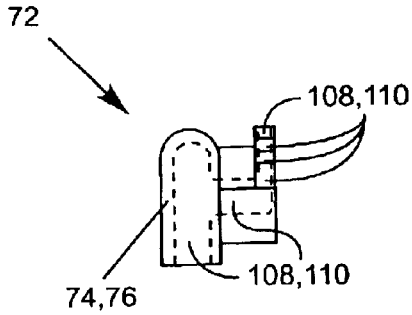
FIG. 19 shows a side view of a gas distribution manifold detailing inlet and outlet manifold channels.

FIG. 19 shows a side view of a gas distribution manifold (72). Inlet port (74) is connected to vein inlet ports (102) via manifold inlet channels (108) in a manner that will allow gas to travel unobstructed between the two. Outlet port (76) is connected to vein outlet ports (104) via manifold outlet channels (110) in a manner that will allow gas to travel unobstructed between the two. Manifold inlet channels (108) and manifold outlet channels (110) are volumes inside manifold (72) void of manifold (72) material.

Figure 20:
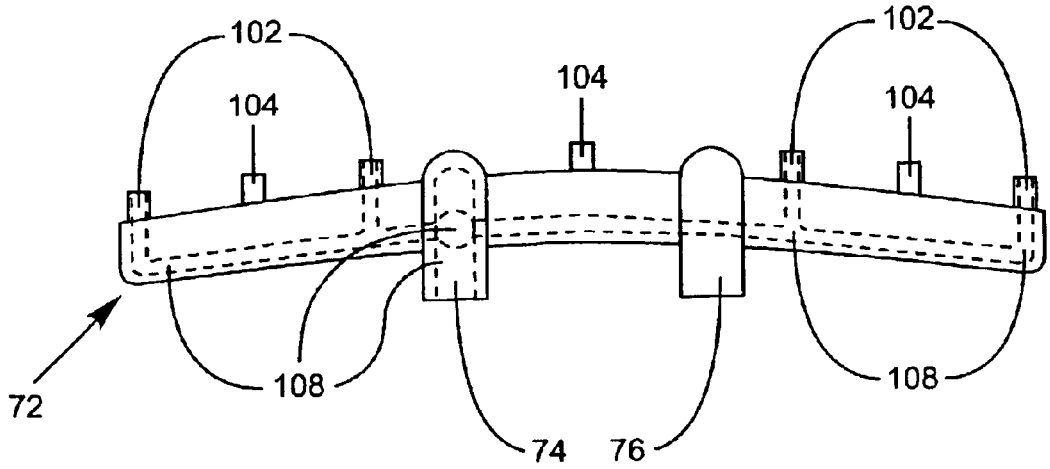
FIG. 20 shows a top view of a gas distribution manifold detailing manifold inlet channels.

FIG. 20 shows a top view gas distribution manifold (72) and the connections of manifold inlet port (74) to vein inlet ports (102) via manifold inlet channels (108). Inlet port (74) is connected to vein inlet ports (102) via manifold inlet channels (108) in a manner that will allow gas to travel unobstructed between the two. Manifold outlet port (76) and vein outlet ports (104) are also shown for reference.

Figure 21:
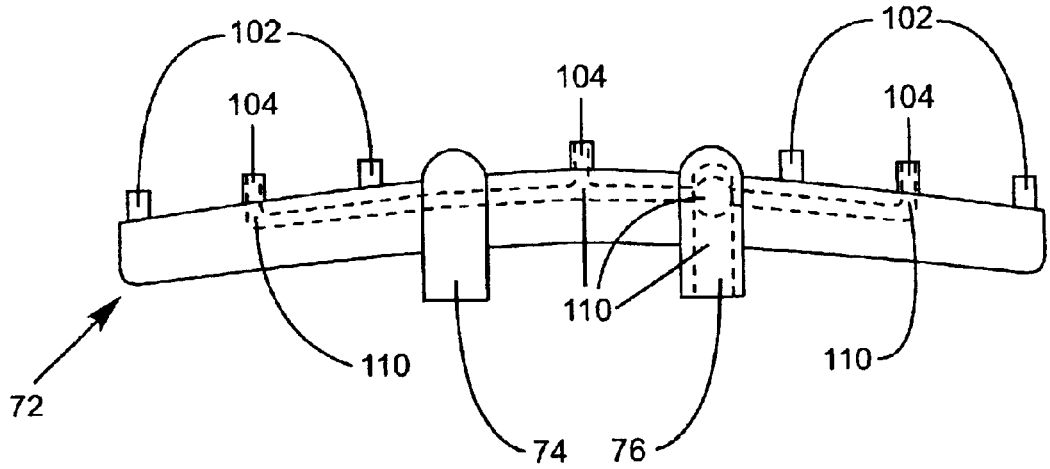
FIG. 21 shows a top view of a gas distribution manifold detailing manifold outlet channels.

FIG. 21 shows a top view of a gas distribution manifold (72) and the connections of outlet port (76) to vein outlet ports (104) via manifold outlet channels (110). Outlet port (76) is connected to vein outlet ports (104) via channels (110) in a manner that will allow gas to travel unobstructed between the two. Manifold inlet port (74) and vein inlet ports (102) are also shown for reference.

OPERATION OF INVENTION

Cooling liquid proof protective glove with positive flow ventilation vein system and gas distribution manifold. FIGS. 12, 13, 14, 15, 16 , 17, 18, 19, 20, 21.

Refer to FIGS. FIGS. 12, 13, 14, 15, 16, 17, 18, 19, 20, and 21 for the following description of operation. A cooling liquid proof protective glove with a positive flow ventilation vein system and a gas distribution manifold would utilize a coolant supply device, one embodiment of which is described later in detail in FIG. 22. The coolant supply device in this embodiment would supply a cooling gas which would be used by the glove as described below. Carbon dioxide gas sublimated from dry ice is one example of this cooling gas. Using FIGS. 12 and 20 for the following description, a cooling gas enters manifold (72) through gas inlet port (74). Cooling gas then travels through and is distributed by manifold inlet channels (108) to vein inlet ports (102) where it will enter the positive flow ventilation vein system of a cooling liquid proof protective glove. The gas would then circulate through veins (56) or vein tubes (106) towards finger and thumb stalls (52) of glove (51) and return towards manifold (72). The cooling gas, now converted to warm exhaust gas by circulating through the glove's vein system covering the glove wearer's warm hand, returns to manifold (72) via vein outlet ports (104). Using FIGS. 21 and 12 or the following description, the warmed exhaust gas travels through manifold outlet channels (110) to manifold outlet port (76) where it is allowed to exit to glove's (51) outside environment.

Referring to FIGS. 15 and 16, a cooling liquid proof protective glove with a positive flow ventilation vein system utilizing vein tubes (106) instead of veins nearly operate in the same manner as would a glove with ventilation veins. The only difference is vein tubes (106) completely contain their vein volume (65). Vein tubes (106) do not allow the cooling gas to directly contact the glove wearer's skin thus protecting the hand from the harsh cold of the cooling gas.

DESCRIPTION OF INVENTION

Dry ice sublimation assembly. FIGS. 22, 23, 24, 25.

Figure 22:
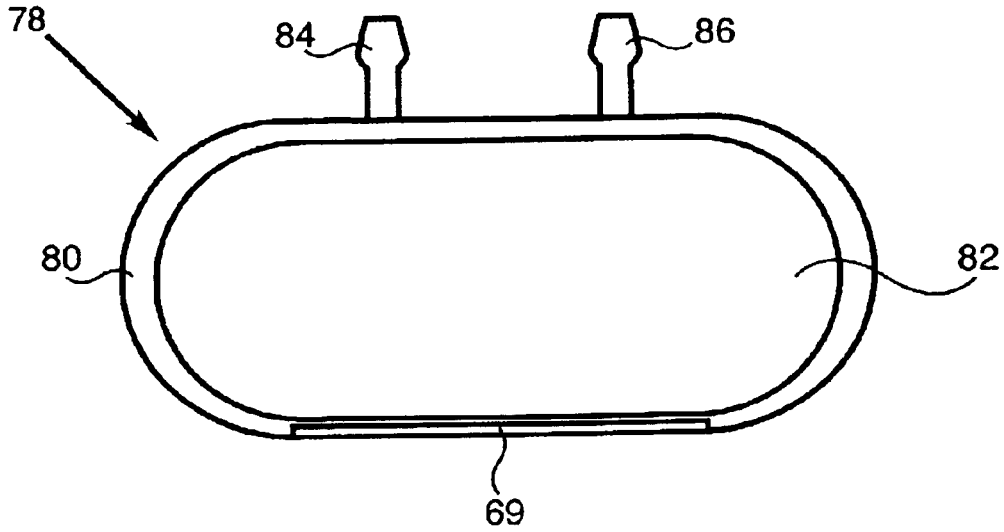
FIG. 22 shows a top view of a dry ice sublimation assembly.
Figure 23:
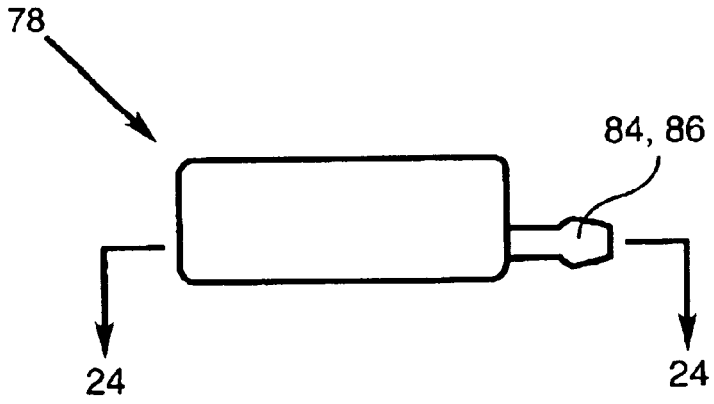
FIG. 23 shows a side view of a dry ice sublimation assembly.

FIG. 22 shows a top view and FIG. 23 shows a side view of a dry ice sublimation assembly (78). A dry ice sublimation assembly (78) is molded or constructed from a rigid or semi-rigid waterproof material and also may incorporate a breathable liquid proof laminate such as a micro porous poly-tetrafluoroethylene (PTFE).

An ice compartment shell (80) comprises the majority of a dry ice sublimation assembly (78). Shell (80) has attached to it an ice compartment door (82), sublimation gas outlet (84), exhaust vapor inlet (86), and a breathable liquid proof material (69). Shell (80) also will contain the dry ice which provides the ice vapor, or cooling gas for the cooling liquid proof protective glove found in FIG. 12. A more detailed description of a dry ice sublimation assembly can be found in FIG. 24, the cut-a-way view from FIG. 23. A more detailed description of a cooling liquid proof protective glove utilizing a dry ice sublimation assembly can be found in FIG. 25.

Figure 24:
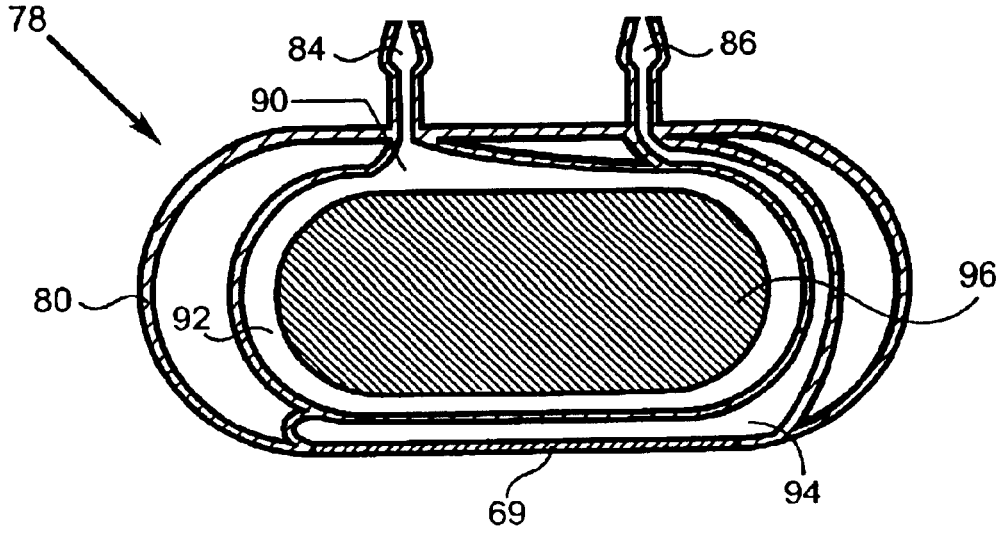
FIG. 24 shows a cut-a-way view of a dry ice sublimation assembly from FIG. 23.

FIG. 24 shows a cut-a-way view from FIG. 23. An ice compartment shell (80) comprises the majority of a dry ice sublimation assembly (78). Shell (80) has sublimation gas outlet (84), exhaust vapor inlet (86), and a breathable liquid proof material (69). A dry ice compartment (92) would contain a predetermined size piece of dry ice (96), and is connected to ice vapor chamber (90). Chamber (90) is connected to sublimation gas outlet (84). Compartment (92), chamber (90) and outlet (84) are all connected in a manner that will allow cooling agent, or carbon dioxide gas in this embodiment, to travel between them. A exhaust vapor inlet (86) is connected to exhaust vapor chamber (94). A breathable waterproof material (69) is connected to a predetermined size and number of holes in shell (80) by a means which provides a durable liquid proof seal between material (69) and the shell (80).

Figure 25:
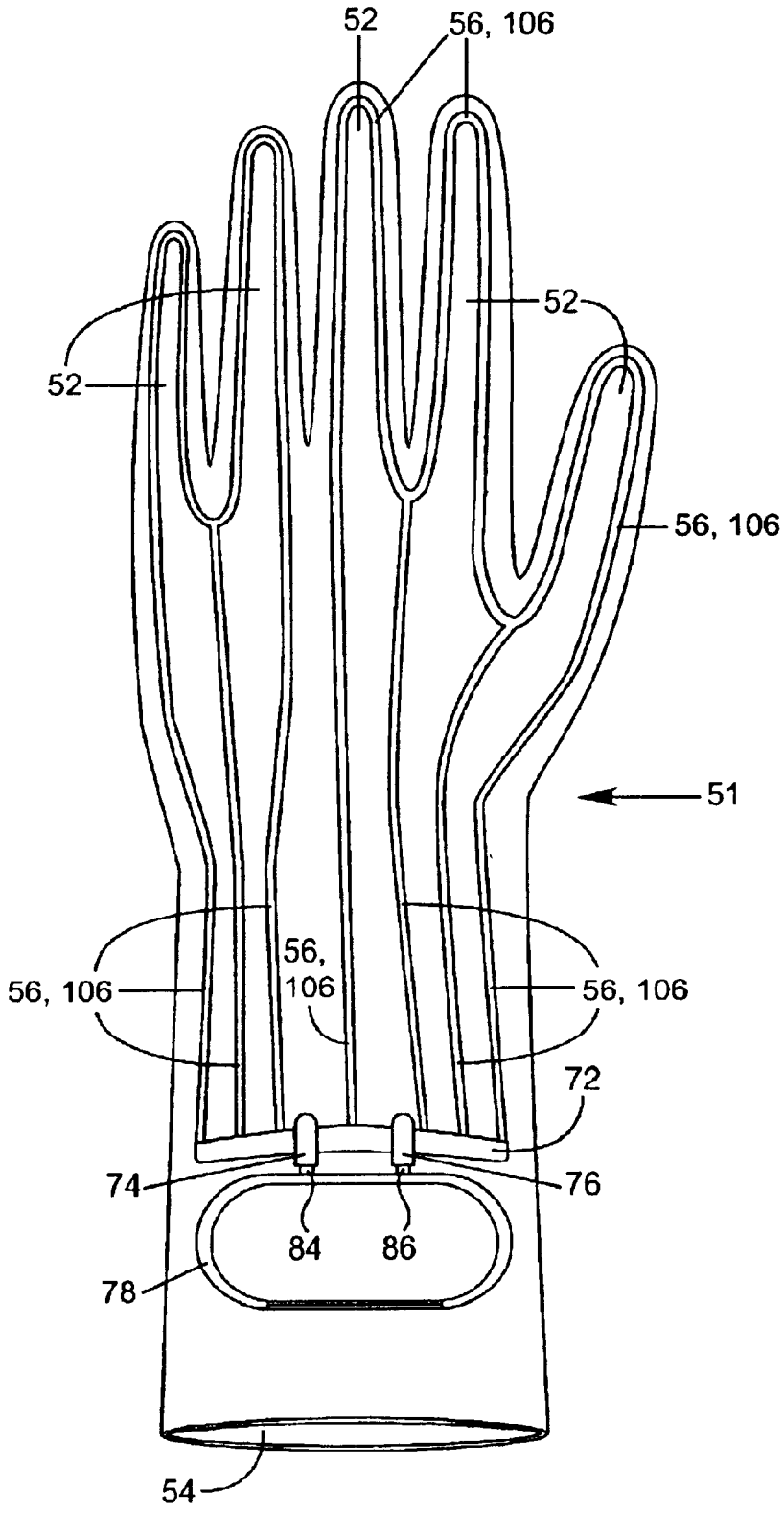
FIG. 25 shows a cooling liquid proof protective glove with a gas distribution manifold and a dry ice sublimation assembly.

FIG. 25 shows a dry ice sublimation assembly (78) attached to a cooling liquid proof protective glove (51). The glove here is identical to the glove described in FIG. 12. Sublimation gas outlet (84) of assembly (78) is attached to manifold inlet port (74) of gas distribution manifold (72) in a manner that will allow gas to travel between and prevent liquids from entering outlet (84) and port (74).

Exhaust vapor inlet (86) of assembly (78) is attached to manifold inlet port (76) of gas distribution manifold (72) in a manner that will allow gas to travel between and prevent liquids from entering inlet (86) and port (76). Wrist opening (54), veins (56) or vein tubes (106), and finger stalls (52) are also shown in this figure.

OPERATION OF INVENTION

Dry ice sublimation assembly. FIGS. 22, 23, 24, 25.

A dry ice sublimation assembly (78) is the source of the cooling medium, ice vapor or cooling gas in this embodiment, for a cooling liquid proof protective glove as described in FIGS. 12 and 25. The cut-a-way view FIG. 24 of FIG. 23 shows the inside of an assembly (78). Dry ice compartment (92) contains a piece of dry ice (96) where it will slowly sublimate from a frozen solid into cool carbon dioxide gas. This cool carbon dioxide gas will also be known as ice vapor in this description. This sublimation process will create a positive gas pressure inside compartment and push the ice vapor into ice vapor chamber (90). The ice vapor will then be forced through chamber (90) and finally through sublimation gas outlet (84) where it can be utilized by a cooling liquid proof protective glove. FIG. 25 shows a dry ice sublimation assembly (78) attached to a cooling liquid proof protective glove (51). Glove (51) in this description is identical to the glove described in FIG. 12.

Referring to FIG. 25 for the following description, the ice vapor will enter manifold inlet port (74) of gas distribution manifold (72) from sublimation gas outlet (84) of assembly (78). Ice vapor will then travel through ventilation veins (56) or vein tubes (106) of glove (51) absorbing the heat produced by the wearer's hand. Ice vapor warmed by the heat it extracted from the wearer's hand and will be referred to as exhaust vapor. Exhaust vapor will return to and enter manifold (72) via veins (56) or tubes (106), and exit glove (51) via manifold outlet port (76). Port (76) is attached to exhaust vapor inlet (86) of assembly (78) in a manner that will allow exhaust vapor to travel between and prevent liquids from entering the two. Returning to FIG. 24, exhaust gas enters exhaust vapor inlet (86) of assembly (78) and travels to exhaust vapor chamber (94). Exhaust vapor collects in chamber (94) until it is allowed to transpire through breathable liquid proof material (66) to the outside environment of assembly (78).

I claim:

1. A single layer protective article of clothing comprising:

a. a glove shell fabricated from a gas, liquid, and solid impermeable, durable and flexible material, b. ventilation veins which are raised portions of said glove material that extend from the wrist portion to the fingers, said veins contain a gas between a hand wearing said glove shell and said glove material, c. ventilation veinletts which are raised portions of said glove material that connect to said veins in a manner that allow gas to travel freely between said veins and veinletts, said veinletts contain a gas between a hand wearing said glove shell and said glove material, d. openings in said veins near the wrist portion of said shell that expose said gas contained by said veins to the exterior environment of said glove shell.

2. A single layer protective article of clothing comprising:

a. a glove shell fabricated from a gas, liquid, and solid impermeable, durable and flexible material, b. ventilation veins which are raised portions of said glove material that extend from the wrist portion to the fingers, said veins contain a gas between a hand wearing said glove shell and said glove material, c. ventilation veinletts which are raised portions of said glove material that connect to said veins in a manner that allow gas to travel freely between said veins and veinletts, said veinletts contain a gas between a hand wearing said glove shell and said glove material, d. pieces of a gas permeable, liquid impermeable material, said pieces are attached to said glove material surrounding holes in said veins so as to provide a liquid impermeable bond from the exterior environment of said shell but to also allow said gas to flow between the interior and exterior environments of said shell through said pieces.

3. A single layer protective article of clothing comprising:

a. a glove shell fabricated from a gas, liquid and solid impermeable, durable and flexible material, b. ventilation veins which are raised portions of said glove material that extend from the wrist portion to the fingers and return to the wrist portion unimpeded, said veins contain a gas between a hand wearing said glove shell and said glove material, c. ventilation veinletts which are raised portions of said glove material that connect to said veins in a manner that allow gas to travel freely between said veins and veinletts, said veinletts contain a gas between a hand wearing said glove shell and said glove material, d. said veins are connected to a manifold near wrist portion of said glove in a manner that will allow said gas to flow between said veins and said manifold while providing a liquid impermeable bond from the exterior environment, said manifold is attached to said glove shell near the wrist portion, e. a gas supply device capable of producing coolant or heated gas from materials contained entirely within said device, said device is attached to said manifold in a manner that will allow said coolant gas to flow between said device and said manifold, said device would allow said gas to evacuate to the exterior environment of the glove after circulating through out said veins, veinletts, and manifold.

4. A single layer protective article of clothing comprising:

a. a glove shell fabricated from a gas, liquid and solid impermeable, durable and flexible material, b. ventilation veins consisting of hollow portions of said glove material which contain a gas that does not contact the hand, said veins extend from the wrist portion to the fingers and return to the wrist portion unimpeded, c. ventilation veinletts consisting of hollow portions of said glove material that connect to said veins in a manner that allow said gas to travel freely between said veins and veinletts, said veinletts contain said gas that does not contact the wearer's skin, d. said veins are connected to a manifold near wrist portion of said glove in a manner that will allow said gas to flow between said veins and said manifold while providing a liquid impermeable bond from the exterior environment, said manifold is attached to said glove shell near the wrist portion, e. a gas supply device capable of producing coolant or heated gas from materials contained entirely within said device, said device is attached to said manifold in a manner that will allow said coolant gas to flow between sad device and said manifold, said device would allow said gas to evacuate to the exterior environment of the glove after circulating through out said veins, veinletts, and manifold.

* * * * *